US006739113B1

(12) United States Patent
Kocher et al.

(10) Patent No.: US 6,739,113 B1
(45) Date of Patent: May 25, 2004

(54) PACKAGE WITH SHRINK FILM LIDSTOCK

(75) Inventors: Patrick N. Kocher, Greenville, SC (US); Kimberly A. Mudar, Greer, SC (US)

(73) Assignee: Cryovac, Inc., Duncan, SC (US)

( * ) Notice: Subject to any disclaimer, the term of this patent is extended or adjusted under 35 U.S.C. 154(b) by 270 days.

(21) Appl. No.: 09/620,202

(22) Filed: Jul. 17, 2000

Related U.S. Application Data

(60) Division of application No. 08/531,355, filed on Sep. 20, 1995, now abandoned, which is a continuation-in-part of application No. 08/371,233, filed on Jan. 11, 1995, now abandoned.

(51) Int. Cl.[7] ..... B65B 7/28; B65B 53/02

(52) U.S. Cl. ..... 53/442; 53/471; 53/485; 53/488

(58) Field of Search ..... 534/427, 442, 534/453, 485, 478, 297, 298, 329.5, 488; 53/471

(56) References Cited

U.S. PATENT DOCUMENTS

| | | | | |
|---|---|---|---|---|
| 3,874,145 A | * | 4/1975 | Schmidt | 53/329.5 |
| 4,070,852 A | | 1/1978 | Mitchell et al. | 53/297 |
| 4,345,412 A | | 8/1982 | Balzer et al. | 53/297 |
| 4,357,288 A | | 11/1982 | Oas et al. | 264/40.6 |
| 4,548,824 A | | 10/1985 | Mitchell et al. | 426/111 |
| 4,617,241 A | | 10/1986 | Mueller | 428/520 |
| 4,642,239 A | * | 2/1987 | Ferrar | 53/442 |
| 4,724,185 A | | 2/1988 | Shah | 428/339 |
| 4,726,984 A | | 2/1988 | Shah | 428/216 |
| 4,755,419 A | | 7/1988 | Shah | 428/220 |
| 4,828,928 A | | 5/1989 | Shah | 428/518 |
| 4,839,235 A | | 6/1989 | Shah | 128/516 |
| 4,847,148 A | | 7/1989 | Schirmer | 428/332 |
| 4,867,336 A | | 9/1989 | Stewart | 53/478 |
| 4,886,690 A | | 12/1989 | Davis et al. | 428/36.6 |
| 4,935,089 A | | 6/1990 | Schirmer | 156/272 |
| 4,958,480 A | * | 9/1990 | Warner | 53/453 |
| 5,004,647 A | | 4/1991 | Shah | 428/349 |
| 5,118,561 A | | 6/1992 | Gusavage et al. | 428/304.2 |
| 5,241,030 A | | 8/1993 | Barry et al. | 526/348.1 |
| 5,249,410 A | * | 10/1993 | Bakker et al. | 53/529.5 |
| 5,350,622 A | | 9/1994 | Speer et al. | 428/215 |
| 5,353,985 A | | 10/1994 | Nageli et al. | 229/123 |
| 5,402,622 A | | 4/1995 | Stockley, III et al. | 53/471 |
| 5,462,756 A | | 10/1995 | Raines et al. | 426/129 |
| 5,520,764 A | | 5/1996 | Toney et al. | 156/244.17 |
| 5,562,958 A | | 10/1996 | Walton et al. | 428/34.9 |

FOREIGN PATENT DOCUMENTS

| | | |
|---|---|---|
| EP | 032 820 | 1/1981 |
| EP | 248 601 | 5/1987 |
| EP | 338 488 | 4/1989 |
| EP | 498 760 A1 | 1/1992 |
| GB | 212 01 99 | 4/1983 |

* cited by examiner

*Primary Examiner*—John Sipos
(74) *Attorney, Agent, or Firm*—Mark B. Quatt

(57) ABSTRACT

A package with improved clarity and a thinner lidstock includes a product support member having a cavity formed therein; a product disposed in the cavity; and an oriented, heat shrinkable lidstock film disposed over the product, and sealed to the product support member. A method of packaging a product includes the steps of providing a product support member having a cavity formed therein, and a flange around the perimeter of the member; placing the product in the cavity formed by the product support member; placing an oriented, heat shrinkable film over the product; sealing the oriented, heat shrinkable film to the flange of the product support member; and cutting at least some of the oriented heat shrinkable film extending beyond the perimeter of the product support member. The lidstock film optionally can be peeled apart after the package has been made, for example to peel an oxygen impermeable portion from a permeable substrate.

4 Claims, 3 Drawing Sheets

PACKAGE WITH SHRINK FILM LIDSTOCK

This is a divisional of application Ser. No. 08/531,355, filed on Sep. 20, 1995, now abandoned, which is a continuation-in-part of application Ser. No. 08/371,233, filed Jan. 11, 1995 now abandoned.

FIELD OF THE INVENTION

The present invention relates to packages for food products, especially meat products, and particularly to packages having a tray and lidstock, in which the lidstock of the package comprises a shrink film, especially a barrier shrink film.

BACKGROUND OF THE INVENTION

It is common practice in packaging many goods, including food items, to use a thermoformed tray. The tray provides a cavity into which a food or other product can be placed. In some applications, instead of thermoforming a web, a preformed tray is used. This can be made from a variety of materials; typical is foamed polystyrene.

A non-forming web (lidstock), typically a laminate, is fed from a roll across the tray, and covers the product. Sometimes, the non-forming web is sealed to the tray edges to form the finished package. Sometimes the lidstock includes an oxygen barrier layer to provide longer shelf life to the packaged product.

To complement the oxygen barrier feature of some lidstocks, and provide a means to adhere the lidstock to the tray, some trays have a film or layer of oxygen barrier material adhered to the interior cavity of the tray. This is done in such a way that the lidstock can be sealed to the oxygen barrier film of the tray. This barrier layer is sometimes supplied by adhering a flexible oxygen barrier film or layer to an e.g. polystyrene foam sheet prior to thermoforming into trays. Alternatively, the oxygen barrier film is adhered to the tray after the tray has been made. U.S. Pat. Nos. 4,847,148 and 4,935,089 (Schirmer) disclose examples of this.

Commercially sold lidstocks suffer from several shortcomings. They tend to have relatively poor optical properties. This means that the aesthetic appearance of the overall package is diminished.

Also, these materials are relatively thick, and therefore raise waste disposal problems.

Where modified atmosphere is used in the interior of the package, the food article oftens absorbs some of the gas, resulting in a loose lidstock.

The inventor has discovered that a trayed package can be made with a shrinkable lidstock, preferably including an oxygen barrier layer. This lidstock provides improved clarity and tightness in the finished package, and a downgauged lidstock which uses less material.

SUMMARY OF THE INVENTION

The present invention provides a package for meat and other products wherein the aesthetic properties of the package are substantially improved, while the thickness of the lidstock is reduced. This result is accomplished while substantially maintaining the overall performance and function of the package in terms of protection of the packaged product.

In one aspect, the present invention relates to a package comprising a product support member having a cavity formed therein; a product disposed in the cavity; and an oriented, heat shrinkable lidstock film disposed over the product, and sealed to the product support member.

In another aspect, the present invention pertains to a method of packaging a product comprising providing a product support member having a cavity formed therein, and a flange around the perimeter of the member; placing the product in the cavity formed by the product support member; placing an oriented, heat shrinkable film over the product; sealing the oriented, heat shrinkable film to the flange of the product support member; and cutting at least some of the oriented, heat shrinkable film extending beyond the perimeter of the product support member.

In a preferred embodiment, a package comprises a foamed polymeric tray having a first surface, said surface defining a cavity formed therein for receiving a food product, and a flange disposed around the periphery of the tray; a thermoplastic film liner adhered to the first surface and the flange of the tray, the film liner comprising an oxygen barrier material; a food product disposed in the cavity; and an oriented, heat shrinkable film disposed over the product, and sealed to the thermoplastic film liner in the region of the flange of the foamed tray, the oriented, heat shrinkable film forming a bead along the flange, the film comprising outer layers comprising an olefinic polymer, and an intermediate layer comprising an oxygen barrier material. The oriented, heat shrinkable film most preferably does not extend beyond the flange of the foamed tray.

The present invention is advantageous in that it offers a package with a thinner lidstock with better optics than conventional laminates. It also provides a package with a neatly trimmed lidstock around the perimeter of the package, along the tray flange, by eliminating excess film overhang. The invention provides a lidstock that offers good package tightness during storage.

DEFINITIONS

Figure 1:
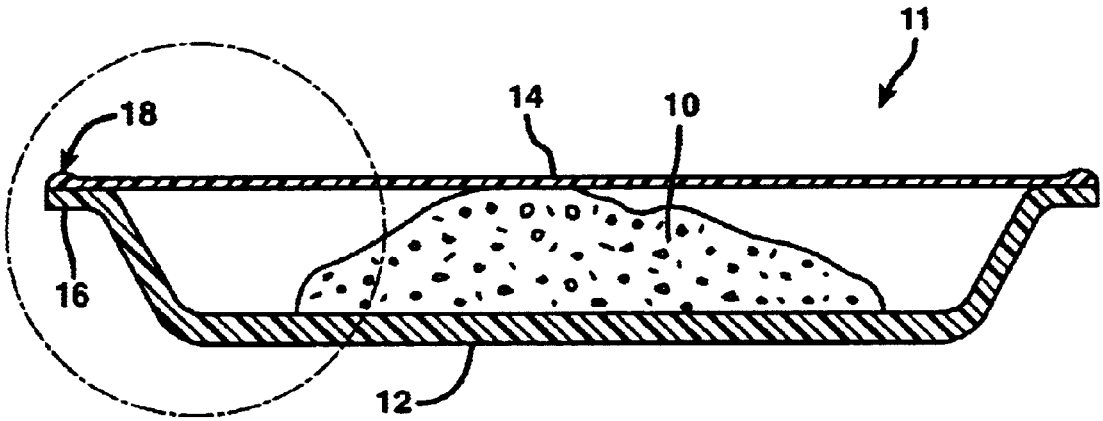
FIG. 1 illustrates a schematic cross-sectional view of a package according to the present invention, the package having a product therein.

As used herein, the phrase "product support member" refers to a component of a package on or in which a product is directly or indirectly placed. Meat products are typically supported on a tray-like package component, typically comprising expanded polystyrene sheet material, which may be thermoformed into a tray or other shape, for supporting the meat product.

As used herein, the phrase "over the product" refers to the position of a package component which is over the product when the product or tray is in an upright position.

As used herein, the phrase "liner" refers to a film, laminate, web, or coating used to line or cover either the interior or exterior surface of a tray or other product support member. If on the interior surface, the liner will typically be in direct contact with the product. "Interior surface" herein is the surface which forms or defines the cavity or space into or onto which the product is placed.

As used herein, "perimeter" refers to the outer edge, when viewed in plan view, of the relevant element, e.g. product support member, flange, liner, or oriented heat shrinkable lidstock.

As used herein, "EVOH" refers to ethylene vinyl alcohol copolymer.

As used herein, the term "oriented" refers to a polymer-containing material which has been stretched at an elevated temperature (the orientation temperature), followed by being "set", while in the stretched configuration, by cooling the material while substantially retaining the stretched dimensions. Upon subsequently heating unrestrained, unannealed, oriented polymer-containing material to its orientation temperature, heat shrinkage results.

As used herein, the term "olefinic", "polyolefin" or the like refers to any polymerized olefin, which can be linear, branched, cyclic, aliphatic, aromatic, substituted, or unsubstituted. More specifically, included in the term are homopolymers of olefins, copolymers of olefins, copolymers of an olefin and a non-olefinic comonomer copolymerizable with the olefin, such as vinyl monomers, modified polymers thereof, and the like. Specific examples include polypropylene homopolymer, polyethylene homopolymer, poly-butene, ethylene/alpha-olefin copolymer, propylene/alpha-olefin copolymer, butene/alpha-olefin copolymer, ethylene/vinyl acetate copolymer (EVA), ethylene/ethyl acrylate copolymer, ethylene/butyl acrylate copolymer, ethylene/methyl acrylate copolymer, ethylene/acrylic acid copolymer, ethylene/methacrylic acid copolymer, modified polyolefin resin, ionomer resin, polymethylpentene, etc.

As used herein, the phrase "ethylene/alpha-olefin copolymer" refers to such heterogeneous materials as linear low density polyethylene (LLDPE), and very low and ultra low density polyethylene (VLDPE and ULDPE); as well as homogeneous polymers such as TAFMER (TM) ethylene/alpha olefin copolymers supplied by Mitsui Petrochemical Corporation and metallocene-catalyzed polymers such as EXACT (TM) materials supplied by Exxon. These materials generally include copolymers of ethylene with one or more comonomers selected from $C_4$ to $C_{10}$ alpha-olefins such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. LLDPE, as used herein, has a density usually in the range of from about 0.91 grams per cubic centimeter to about 0.94 grams per cubic centimeter. Other ethylene/alpha-olefin copolymers, such as the long chain branched homogeneous ethylene/alpha-olefin copolymers available from the Dow Chemical Company, known as AFFINITY (TM) resins, are also included as another type of ethylene/alpha-olefin copolymer useful in the present invention.

As used herein, the phrase "ionomer resin" refers to a product of an ionic polymerization, i.e., a polymer containing interchain ionic bonding. Preferably, the ionomer comprises at least one member selected from the group consisting of a thermoplastic resin based on metal salt of an alkene/acid copolymer; more preferably, a thermoplastic resin based on metal salt of ethylene/acid copolymer; still more preferably, ethylene/methacrylic acid copolymer. As used herein, the term "ionomer" also includes ethylene/acrylic acid copolymer and ethylene/acid/acrylate terpolymer.

As used herein, the terms "core" or "intermediate", as applied to multilayer films, refer to any internal film layer which has a primary function other than serving as an adhesive or compatibilizer for adhering two layers to one another. Usually, a core or intermediate layer provides the multilayer film with a desired level of strength, i.e., modulus, and/or optics, and/or abuse-resistance, and/or oxygen impermeability.

As used herein, the phrase "tie layer" refers to any internal layer having the primary purpose of adhering two layers to one another.

As used herein, the term "barrier", and the phrase "barrier layer", as applied to films and/or film layers, is used with reference to the ability of a film or film layer to serve as a barrier to one or more gases. Oxygen barrier layers, i.e., $O_2$ barrier layers, can comprise, for example, ethylene/vinyl alcohol copolymer, polyvinyl chloride, polyvinylidene chloride, polyamide, polyester, polyacrylonitrile, etc.

As used herein, the term "peelable" refers to the capability of removing one or more layers of a multilayer film by manually peeling back the layers along a plane or interface of relatively low bond strength.

Clarity is measured according to ASTM D 1746.

Tensile strength, elongation, and modulus are measured according to ASTM D 882.

Tear propagation is measured according to ASTM D 1938.

Shrink tension is measured according to ASTM D 2838.

Free shrink is measured according to ASTM D 2732.

Oxygen transmission rate is measured according to ASTM D 3985.

DETAILED DESCRIPTION OF THE INVENTION

FIG. 1 illustrates package 11 having meat product 10 therein, the meat product being on tray 12. Oriented, heat shrinkable lidstock film 14 encloses product 10 on tray 12. Film 14 is heat sealed to the tray 12 at flange 16. A bead 18 marks the edge of film 14.

Figure 2:
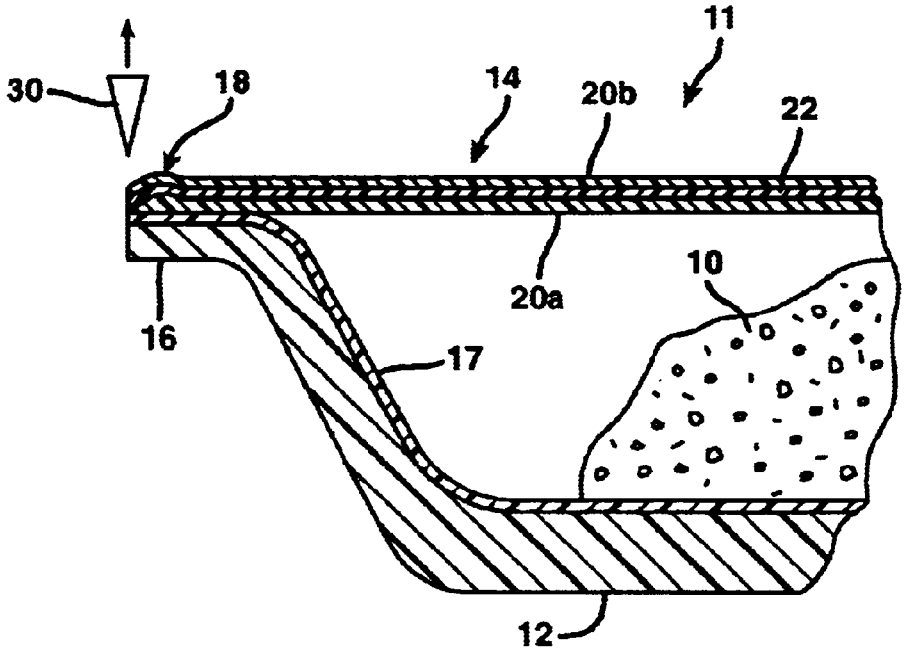
FIG. 2 illustrates an enlarged view of a portion of the package illustrated in FIG. 1.

FIG. 2 is an enlargement of the portion of the package of FIG. 1 enclosed in the circle of FIG. 1. Like parts are identified by the same numbering as in FIG. 1.

The oriented, heat shrinkable lidstock film 14 is further depicted as a three layer film in which outer layers 20*a* and 20*b* enclose an intermediate layer 22. Any suitable monolayer or multilayer film can be used for lidstock film 14, provided that it is oriented and heat shrinkable. More preferably, the oriented heat shrinkable lidstock film is a multilayer film. Most preferably, it includes a layer comprising an oxygen barrier polymer, to extend the shelf life of the packaged article. In general, this multilayer film can comprise from 2 to 20 layers; preferably, from 3 to 10 layers; and more preferably, from 4 to 8 layers.

Preferably, the oriented, heat shrinkable lidstock film used in the present invention has a total thickness (i.e., a combined thickness of all layers), of from 0.1 to 2 mils (1 mil equals 0.001 inch); more preferably, from 0.3 to 1.5 mils; and still more preferably, from 0.4 to 1.2 mils.

Oriented, heat shrinkable lidstock film 14 comprises any suitable polymer or combination of polymers. Preferred are olefinic outer layers 20*a* and 20*b*, and e.g. EVOH, saran (vinylidene chloride copolymer), nylon (polyamide), polyethylene terephthalate ("PET") or other suitable oxygen barrier material for intermediate layer 22. Suitable tie layers can be used as needed to bond adjacent layers together. Especially preferred materials are BDF 2001 and BDF 2050, sold by W.R.Grace & Co.—Conn. These and other suitable films are described in U.S. Pat. Nos. 4,724,185, 4,726,984, 4,755,419, 4,828,928, 4,839,235, and 5,004,647, all incorporated herein by reference in their entirety. Both BDF materials are biaxially oriented, heat shrinkable films, and have a core layer of ethylene vinyl alcohol copolymer and nylon; skin layers of a blend of ethylene octene copolymer and ethylene vinyl acetate copolymer, and intermediate layers of an anhydride grafted olefinic copolymer.

Examples of suitable materials for oriented, heat shrinkable lidstock film 14, and especially the outer layers of the film, include such olefinic materials as ethylene/vinyl acetate copolymer, ionomer, ethylene/alpha-olefin copolymer, especially homogeneous ethylene/alpha-olefin copolymer, ultra low density polyethylene ("ULDPE"), ethylene/n-butyl acrylate copolymer ("EnBA"), ethylene/methyl acrylate copolymer ("EMA"), low density polyethylene, and plasticized polyvinyl chloride. SSD-351 (TM) stretch olefin film, obtainable from W.R. Grace & Co.—Conn., of Duncan, S.C., and SSD-310 (TM) stretch olefin film, also obtainable from W.R. Grace & Co.—Conn., of Duncan, S.C., are also suitable films for use in the present invention. The latter product is described in U.S. Pat. No. 4,617,241 incorporated herein by reference in its entirety. Preferred oriented, heat shrinkable lidstock films are at least partially crosslinked, preferably by electronic crosslinking.

FIG. 2 illustrates a thermoplastic film liner 17. Like lidstock film 14, thermoplastic film liner 17 can comprise any suitable material, such as those indicated above for lidstock film 14. Thermoplastic film liner 17 functions to allow or facilitate the sealing of lidstock film 14 to the tray 12 in the flange region 16 of the tray. Film liner 17 also preferably includes an oxygen barrier layer, such as those identified above for film 14.

Thermoplastic film liner can be a monolayer film or a multilayer film. It can have any total thickness desired, so long as the film provides the desired properties for the particular packaging operation in which the film is used.

A sequence of making the package is as follows. A tray is provided, with if necessary or beneficial a thermoplastic film liner adhered by any suitable means to its interior surface, as shown in FIG. 2. A meat or other product is placed in the cavity formed by the tray. An oriented, heat shrinkable lidstock material is placed over and sealed to the tray in the flange area of the tray. A knife 30 or equivalent means is brought down near the outer edge of the tray, or within the flange region of the tray. Some or all of the excess film material extending beyond the edge of the tray or flange is then cut away. If a heated cutting means is used, the heat of the heated knife causes the remaining oriented heat shrinkable film to shrink back in the flange area of the tray, and form a bead 18 along the flange.

Figure 3:
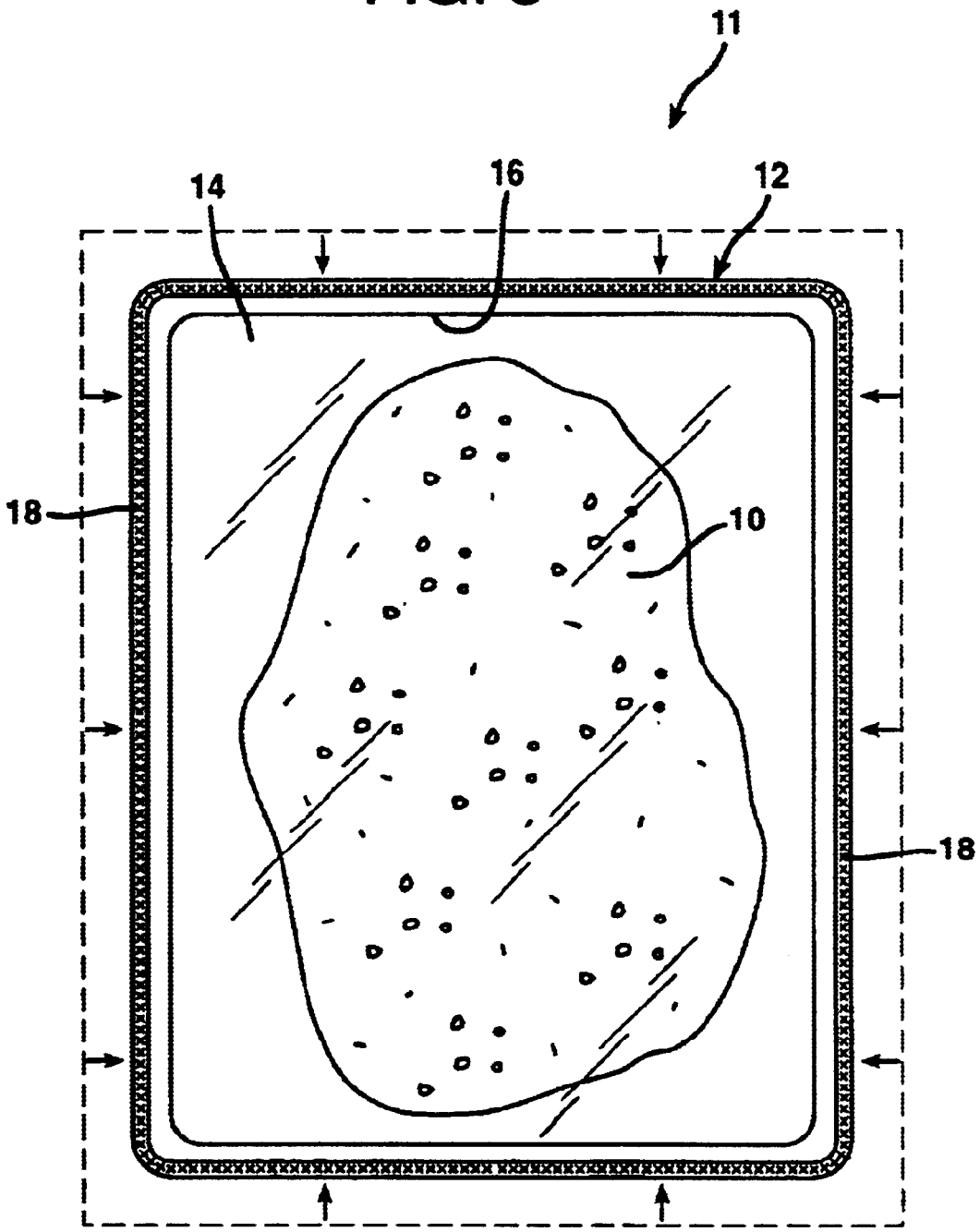
FIG. 3 illustrates a schematic plan view of the package illustrated in FIG.

FIG. 3 illustrates the inventive package and process in schematic plan view. The outer dashed lines represent the original spacial extent of excess lidstock film 14 before cutting; the bead 18 is shown along the perimeter of the tray flange after cutting and heating film 14, and subsequent shrink back occurs. Arrows appearing around the perimeter of the tray show the direction of shrink back after cutting and heating.

In general, any suitable product support member may be used, either alone, or optionally in combination with one or more supplemental product support members. Preferably, a tray is used. More preferably, the tray comprises a thermoformed foam sheet, or a thermoformed or molded rigid sheet tray, or any other support member which may be preformed or formed in-line during packaging. In general, the product support member may comprise any suitable material as known to those of skill in the art, such as polyolefin; preferably, the support member comprises at least one member selected from the group consisting of polyvinylchloride, polystyrene, polypropylene, polyethylene terephthalate, and cellulose; more preferably, tray 12 comprises polystyrene; still more preferably, tray 12 comprises polystyrene foam.

Conventional processes and packaging equipment well known in the art can be used to accomplish each of the basic steps discussed above. The step of cutting/heating to induce shrink back can be done by modifying conventional packaging equipment, or providing additional equipment to cut the excess lidstock film that extends beyond the edge of the tray flange, and heat the film to cause shrinkback into or on the flange area. A hot knife or other suitable cutting/heating means such as hot wire or laser can be used.

Thus, film 14 is sealed to tray 12 at the perimeter thereof, preferably in a flange area, and preferably films 14 and 17 are preferably heat-sealed to each other around the perimeter of tray 12.

Although the package of the present invention is useful for the packaging of any product, the package is especially suited to the packaging of meat products such as ground beef.

The present invention is further illustrated by the following examples and data. Unless stated otherwise, all percentages, parts, etc., are by weight.

EXAMPLE 1

Several tests were conducted to evaluate 100 gauge BDF-2050 (Example 1) as a lidstock, and compare it with a conventional lidstock believed to have a polyethylene terephthalate substrate as a sealant with saran and ethylene vinyl acetate copolymer as additional layers (Comparative Example 1).

Packages were made on a Ross 580 machine. In the case of the film of Example 1, the machine was modified by placing teflon tape on top of the heating plate in the upper chamber. Alternatively, the seal bars could be recessed to prevent premature shrinkage of the BDF film. After the packages were made, they were advanced to a station where a mechanical knife cut the excess film. Because this was not a heated knife, the remaining film along the edge of the package did not shrink back to form a bead. These particular tests were intended only to establish some basic fitness-for-use data.

Three fitness-for-use criteria were used to see whether the oriented, heat shrinkable BDF film was comparable in performance with conventional lidstock. These were shelf-life test, drop test, and shaker test.

The shelf life test using ground beef was conducted to compare Example 1 and comparative Example 1 in terms of gas, color, and microbial counts. Packages containing one pound of ground beef (ground in the packaging lab) in foamed polystyrene trays having an inner surface lined with a barrier film were vacuum/gas flushed with 80% oxygen 20% carbon dioxide. The barrier film liner had the following film structure: a sealant layer (the film layer to be sealed to the BDF lidstock in the flange area of the tray) of LLDPE; a tie layer of an anhydride modified polyolefin; an EVOH layer; another tie layer; and a layer of ethylene methyl acrylate copolymer for bonding to the foamed polystyrene tray. Fifteen packages were made for each type of lidding film and evaluated over an 11 day period.

The result was that in general there were no differences between the two lidding films. Over time, the oxygen concentration of the package with BDF film was higher than with the conventional lidstock, but the differences were not significant. There were no significant differences in color values except on the last day, when the packages with BDF had significantly greater red color as measured by Hunter "a" value. No significant differences in total aerobic plate counts were seen. The conclusion is that in terms of desired product shelf life, the oriented, heat shrinkable film of example 1 is fit-for-use as a lidstock in combination with a barrier lined foam tray and a modified atmosphere.

The drop tests used the same type of barrier lined foam trays. Packages were made with the BDF film lidstock. Each package was over-pressured with gas, and contained a one (1) pound water bag. The packages were stacked 12 to a case (4 columns, 3 deep). A total of 8 cases (96 packages) were dropped 3 feet each. Each package was evaluated for damaged seals or film. Two additional cases were stored for one week at 35° F. and dropped to determine the effect of cold storage on the seals. Seal conditions were 270° F. for 1.3 seconds. Gas flush time was 0.65 seconds. The result was that none of the 96 packages dropped were damaged in any way.

The shaker tests used the same type of barrier lined foam trays. Packages were made with the BDF film lidstock. Each package was over-pressured with gas, and contained a one (1) pound water bag. The packages were stacked 12 to a case (4 columns, 3 deep). A total of six cases (72 packages) were vibrated over a one hour period using a simulated truck program. Packages were then evaluated for seal/film damage. Seal and gas flush conditions were the same as used in drop testing. The shaker testing was done to anticipate any problems in seal integrity or film delamination during transportation. If the overlap of film on the flange is pulled with enough force, the BDF film will delaminate rather than lift off the flange seal area. The result was that none of the 72 packages tested had damaged seals or exhibited any type of delamination.

Clarity and thickness values for Example 1 and Comparative Example 1 appear in Table 1 below. Also included is an additional Comparative Example 2, which is a conventional, commercial lidstock available from the assignee. The lidstock of Comparative Example 2 has an LLDPE/EVA/EVA sealant bonded at the EVA layer to a saran coated polyester.

TABLE 1

| Example | Clarity (%) | Gauge (mils) |
|---|---|---|
| 1 | 79 | 1.2 |
| comp. 1 | 35 | 3.2 |
| comp. 2 | 29 | 2.6 |

Oriented heat shrinkable lidstock films of the present invention have a clarity of preferably at least 40%, more preferably at least 50%, most preferably at least 60%. Clarity is measured per ASTM D 1746.

EXAMPLE 2

A shrink film having the construction:

polyolefin/tie/EVOH/tie/polyolefin is adhered to a foamed polystyrene tray having an oxygen barrier film adhered to the interior cavity of the tray.

EXAMPLE 3

A shrink film having the construction:

polyolefin/tie/polyamide/EVOH/polyamide/tie/ polylefin is adhered to a foamed polystyrene tray having an oxygen barrier film adhered to the interior cavity of the tray.

EXAMPLE 4

A shrink film having the construction:

$$\text{polyolefin/tie}_2\text{/polyamide}_1\text{/EVOH/polyamide}_1\text{/tie}_2\text{/polyolefin}$$
$$+ \qquad\qquad +$$
$$\text{polyamide}_2 \qquad \text{polyamide}_2$$

was adhered to a foamed polystyrene tray having a film having an oxygen barrier material adhered to the interior cavity of the tray. The package was made on a Ross 580 machine. The machine was modified by placing teflon tape on top of the heating plate in the upper chamber. After the packages were made, they were advanced to a station where a mechanical knife cut the excess film. This was not a heated knife, and the remaining film along the edge of the package did not shrink back to form a bead. Thus, with this mechanical cut, excess film overhung the tray flanges.

It was discovered that this film could be peeled back to remove some of the layers from the multilayer shrink film lidstock. Peel was initiated at one corner of the extended portion of the shrink lidstock. It is believed that the oxygen barrier portion of the film, including the EVOH and both polyamide layers (herein "impermeable portion"), was peeled from the film. This left the tie and polyolefin layers adhered to the tray. These remaining layers, referred to herein as the permeable substrate, have relatively high oxygen transmission.

For end-use applications such as case-ready beef, it is desirable to package and store a meat product in a package having good initial oxygen barrier properties, and then, when the package is put in a retail display case, remove the oxygen barrier component to create an oxygen permeable package and promote blooming (onset of red color) in the meat product. The package of example 4 provides a peelable shrink film lidstock for such a package.

For peelable embodiments, the bond between the sealant layer of the lidstock and the support member has a strength which is greater than the force required to peel the impermeable portion from the permeable substrate. In this manner, the impermeable portion can be peeled from the permeable substrate and the product will continue to be fully contained within the package.

The peel force between the permeable substrate and impermeable portion is preferably between 0.001 and 2.5 lb/inch. A more preferred peel force between the two portions is between 0.005 and 2 lb/inch, most preferably between 0.01 and 1.5 lb/inch. A peel force falling within these ranges provides a balance between sufficient adhesion to prevent premature film separation, e.g., during manufacture, shipping and storage, and sufficient peelability so that the two portions can be separated without tearing or otherwise compromising the permeable substrate. A peel force of more than about 2.5 lb/inch results in a lidstock film that is more difficult to peel, or can result in unintended separation of the entire lidstock from the support member. On the other hand, a peel force of less than about 0.001 lb/inch creates a greater likelihood of premature delamination of the film.

Figure 4:
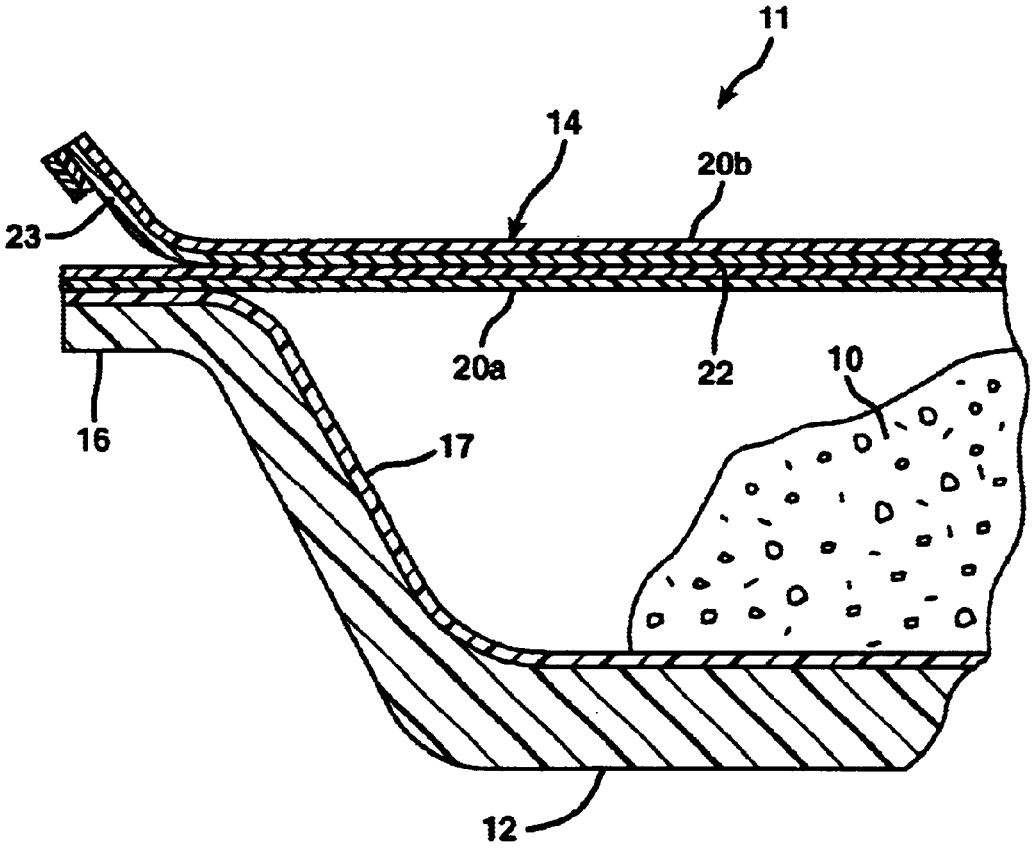
FIG. 4 illustrates an alternative embodiment of the present invention, the package having a peelable shrinkable lidstock.

FIG. 4 is like FIG. 2, but shows a peelable shrink lidstock film 14 further depicted as a four layer film in which sealant layer 20*a* and outer layer 20*b* enclose an intermediate layer 22 and oxygen barrier layer 23. The impermeable portion represented in the drawing by outer layer 20*b* and oxygen barrier layer 23, is peeled away from the permeable portion represented by sealant layer 20*a* and intermediate layer 22.

If desired, a suitable tab, header, or the like can be placed at one end of the package to initiate peel.

In Example 4, the outer polyolefin layers were a blend of about 70% LLDPE (Dowlex 2045.04 from Dow), 24% linear medium density polyethylene (LMDPE) (Dowlex 2037 from Dow), and about 6% slip additives. Polyamide, was nylon 6,66 (Ultramid C 35 from BASF) and $Polyamide_2$ was nylon 6,12 (Grilon CF 6S from Emser). $Tie_1$ and $Tie_2$ were both anhydride-grafted polyolefinic adhesives (Bynel CXA 4104 from Du Pont.

Table 2 below shows several properties of the shrink lidstock of Example 4 compared with other films, and including the interlaminar bond strength between the $Tie_1$ and $Polyamide_1$ layers (noted in the Table 2 as "$Tie_1$–$PA_1$) and the $Tie_2$ and $Polyamide_2$ layers (noted as "$Tie_2$–$PA_2$"). It is compared with standard BDF 2050 and other films. The table shows that the tie/polyamide interfaces offer significantly lower interlaminar adhesion ("bond strength") making the film of Example 4 especially preferred for peelable shrink lidstock applications.

In Table 2:

"$BDF\ 2050_1$" refers to a standard heat shrinkable film as described hereinabove;

"$BDF\ 2050_2$" refers to a standard heat shrinkable film as described hereinabove, but which has been annealed (heat set) such that the final layflat width of the annealed film is 4% less than the layflat width of the film before annealing;

"$BDF\ 2050_3$" refers to a standard heat shrinkable film as described hereinabove, but which has been annealed such that the final layflat width of the annealed film is 8% less than the layflat width of the film before annealing; and Example 5 is a shrink film like that of Example 4, but which included a small amount of ethylene vinyl acetate copolymer in the outer layers.

TABLE 2

| PROPERTY | $BDF\ 2050_1$ | $BDF\ 2050_2$ | $BDF\ 2050_3$ | EXAMPLE 4 | EXAMPLE 5 |
|---|---|---|---|---|---|
| Tensile strength (psi × 1000) long. | 13 | 14 | 13 | 17 | 18 |
| Elongation (%) long. | 86 | 91 | 82 | 94 | 94 |
| Modulus (psi × 1000) long. | 94 | 96 | 67 | 133 | 134 |
| Tensile strength (psi × 1000) trans. | 11 | 11 | 11 | 16 | 18 |
| Elongation (%) trans. | 136 | 114 | 114 | 79 | 70 |
| Modulus (psi × 1000) trans. | 89 | 90 | 92 | 131 | 143 |
| Tear Property (grams) long. | 42 | 19 | 16 | 13 | 19 |
| Tear Property (grams) trans. | 12 | 32 | 33 | 10 | 36 |
| Bond Strength $Tie_1$-$PA_1$ (lb/inch) | 0.14 | 0.19 | 0.13 | 0.02 | 0.02 |
| Bond Strength $Tie_2$-$PA_2$ (lb/inch) | 0.15 | 0.19 | 0.16 | 0.02 | 0.03 |
| Inst. Impact (12 ft./sec.) | | | | | |
| Peak Load (lb) | 19 | 18 | 21 | 25 | 28 |
| Gradient (lb/inch) | 32 | 29 | 34 | 43 | 46 |
| Energy at Break (ft.-lbs.) | 0.4 | 0.4 | 0.4 | 0.5 | 0.6 |
| Shrink Tension trans. $lb/in.^2$ @ | | | | | |
| 180° F. | 471 | 385 | 285 | 569 | 569 |
| 200° F. | 518 | 467 | 397 | 619 | 573 |
| 220° F. | 596 | 456 | 404 | 617 | 629 |
| 240° F. | 515 | 448 | 413 | 615 | 553 |
| 260° F. | 492 | 457 | 414 | 644 | 652 |
| Free Shrink trans. % @ | | | | | |
| 180° F. | 16 | 14 | 9 | 14 | 15 |
| 200° F. | 23 | 22 | 20 | 20 | 21 |
| 220° F. | 31 | 32 | 30 | 25 | 29 |
| 240° F. | 58 | 59 | 56 | 42 | 44 |
| 260° F. | 64 | 65 | 63 | 55 | 54 |

Five packages were prepared in which the lidstock film of Example 4 sealed in each case to a foamed polystyrene tray. The lidstock film of each package was peeled back, leaving behind a permeable substrate. The oxygen transmission rate (OTR) of this substrate was measured using an OX-TRAN measuring device at 73° F. at 0% relative humidity (ASTM D 3985). The results are shown below in Table 3.

TABLE 3

| SAMPLE | OTR cc @ STP/24 hours, m2, atmosphere | GAUGE mils |
|---|---|---|
| 1 | 16,800 | 0.39 |
| 2 | 20,100 | 0.37 |
| 3 | 19,700 | 0.36 |
| 4 | 16,300 | 0.38 |
| 5 | 17,100 | 0.38 |
| SSD 310 | 13,700 | 0.64 |
| SSD 310 | 11,600 | 0.72 |

The interlaminar bond strength of peelable embodiments of the shrink film lidstock of the present invention can vary depending on the exact composition of the specific film, method of production, and the like. Table 4 shows four lip seal readings taken for each of five packages. For each package, four specimens were taken; each had a small (approx. 1 inch long by 1 inch wide) section of the foamed tray, and adhered thereto, a small (approx. 1 inch long by 1 inch wide) section of the lidstock film of Example 4.

Using an Instron tester, peel was initiated by pulling the foamed section with the permeable substrate adhered thereto, from the impermeable portion of the lidstock. This was done for each of the 20 samples. Table 4 records the force required to initiate peel in the flange seal area of each specimen.

Table 5 records the peel force required to continue the delamination of what is believed to be the $Tie_2$–$PA_2$ interface of the lidstock, for each of the 20 samples.

TABLE 4

| SAMPLE | LOAD AT MAX. (lb/inch) |
|---|---|
| 1 | 1.6 |
| 2 | 1.2 |
| 3 | 1.8 |
| 4 | 2.3 |
| 5 | 2.1 |
| 6 | 1.4 |
| 7 | 1.3 |
| 8 | 0.7 |
| 9 | 1.3 |
| 10 | 0.8 |
| 11 | 1.8 |
| 12 | 1.3 |
| 13 | 1.0 |
| 14 | 1.8 |
| 15 | 1.4 |
| 16 | 0.7 |
| 17 | 1.3 |
| 18 | 0.9 |
| 19 | 1.3 |
| 20 | 0.9 |
| Mean | 1.3 |

TABLE 5

| SAMPLE | AVG. LOAD Between limits (lb/inch) |
|---|---|
| 1 | 0.015 |
| 2 | 0.014 |
| 3 | 0.016 |
| 4 | 0.006 |
| 5 | 0.010 |
| 6 | 0.002 |
| 7 | 0.003 |
| 8 | 0.004 |
| 9 | 0.009 |
| 10 | 0.010 |
| 11 | 0.015 |
| 12 | 0.009 |
| 13 | 0.015 |
| 14 | 0.022 |
| 15 | 0.033 |
| 16 | 0.024 |
| 17 | 0.024 |
| 18 | 0.019 |
| 19 | 0.021 |
| 20 | 0.013 |
| Mean | 0.014 |
| S.D. | 0.008 |

Packages made in accordance with the present invention can optionally include modified atmosphere in the cavity formed by the support member and shrink lidstock. For meat packaging applications where a red color is desired at the time the is made, and where the lidstock has an oxygen barrier component, a high oxygen atmosphere having in excess of 20% oxygen is sometimes preferred. For embodiments such as peelable lidstock, where the lidstock has an oxygen barrier component, an atmosphere with a predominance of nitrogen and carbon dioxide is sometimes preferred. This latter embodiment provides extended shelf life of a meat product during distribution and storage, and the capability of then peeling away the impermeable portion when the package is displayed for sale at a retail outlet. Removal of the impermeable portion allows oxygen to enter the package interior through the permeable substrate, causing the meat to bloom.

Although the present invention has been described in connection with the preferred embodiments, it is to be understood that modifications may be utilized without departing from the principles and scope of the invention, as those skilled in the art will readily understand. Accordingly, such modifications may be practiced within the scope of the following claims.

For example, although annealed embodiments of the lidstock of the invention are disclosed herein, the lidstock can be alternatively heat set.

What is claimed is:

1. A method of packaging a product comprising:

a) providing a product support member having
   i) a cavity formed therein, and
   ii) a flange around the perimeter of the member;

b) placing the product in the cavity formed by the product support member;

c) placing an oriented, heat shrinkable film over the product;

d) sealing the oriented, heat shrinkable film to the flange of the product support member;

e) cutting at least some of the oriented, heat shrinkable film at a location beyond the perimeter of the product support member; using a heated means for cutting; and f) shrinking the oriented, heat shrinkable film extending beyond the perimeter of the product support member such that the oriented, heat shrinkable film shrinks back to the flange and forms a bead thereon.

2. The method according to claim 1, wherein the heated means for cutting comprises a hot knife.

3. The method according to claim 1, further comprising providing a product support member having a thermoplastic film liner adhered to the flange of the product support member, and sealing the oriented, heat shrinkable film to the thermoplastic film liner in the region of the flange of the product support member.

4. The method of claim 1, wherein the oriented, heat shrinkable film comprises two adjacent film layers, said layers being peelable from each other at a peel force of between 0.001 and 2.5 pounds per inch.

* * * * *